US008605913B2

(12) United States Patent
Schwerdtner

(10) Patent No.: US 8,605,913 B2
(45) Date of Patent: Dec. 10, 2013

(54) RIGHT/LEFT DETECTION IN HEARING AIDS

(75) Inventor: Claus-Dieter Schwerdtner, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1120 days.

(21) Appl. No.: 12/560,643

(22) Filed: Sep. 16, 2009

(65) Prior Publication Data

US 2010/0067707 A1 Mar. 18, 2010

(30) Foreign Application Priority Data

Sep. 17, 2008 (DE) ..... 10 2008 047 577

(51) Int. Cl.
*H04R 25/00* (2006.01)

(52) U.S. Cl.
USPC ..... 381/23.1; 381/331; 381/329

(58) Field of Classification Search
USPC ..... 381/23.1, 312–331, 60, 340, 370, 79; 379/52
See application file for complete search history.

(56) References Cited

U.S. PATENT DOCUMENTS

| | | | | |
|---|---|---|---|---|
| 6,549,633 | B1 * | 4/2003 | Westermann | 381/312 |
| 7,120,501 | B2 * | 10/2006 | Boylston et al. | 607/57 |
| 2002/0106096 | A1 | 8/2002 | Vonlanthen | |
| 2004/0042629 | A1 * | 3/2004 | Mellone et al. | 381/310 |
| 2006/0044140 | A1 | 3/2006 | Berg | |
| 2008/0044047 | A1 | 2/2008 | Kral et al. | |

FOREIGN PATENT DOCUMENTS

| | | | |
|---|---|---|---|
| DE | 10032936 | A1 | 2/2002 |
| EP | 1562399 | A2 | 8/2005 |
| EP | 1629801 | A1 | 3/2006 |
| EP | 1722597 | A1 | 11/2006 |
| EP | 1890522 | A1 | 2/2008 |
| WO | WO 2004077087 | A2 | 9/2004 |

OTHER PUBLICATIONS

Rainer et al., "Advances in Digital Speech Transmission", Jan. 10, 2008, pp. 406-407, XP002556180, ISBN 987013139139, John Wiley & Sons LTD, http://dx.doi.org/10.1002/9780470727188.

* cited by examiner

*Primary Examiner* — Davetta W Goins
*Assistant Examiner* — Oyesola C Ojo

(57) ABSTRACT

In a hearing aid system having a first hearing aid and a second hearing aid for providing binaural hearing assistance to a user, the hearing aid for providing hearing assistance to the left ear can easily be confused with the hearing aid for providing hearing assistance to the right ear. The invention proposes a side detection device by means of which each hearing aid detects on or in which ear of the user it is currently being worn. Advantageously, the parameter settings for providing hearing assistance to both ears are stored in both hearing aids of a respective hearing aid system, with the result that following the automatic detection of the respective ear in which the respective hearing aid is currently being worn the corresponding parameter settings are also activated automatically.

12 Claims, 2 Drawing Sheets

RIGHT/LEFT DETECTION IN HEARING AIDS

CROSS REFERENCE TO RELATED APPLICATIONS

This application claims priority of German application No. 10 2008 047 577.7 filed Sep. 17, 2008, which is incorporated by reference herein in its entirety.

FIELD OF THE INVENTION

The invention relates to a hearing aid system having a first and a second hearing aid, each of which can be worn either on a user's left ear or on a user's right ear.

BACKGROUND OF THE INVENTION

Most users of hearing aids are affected by hearing loss on both sides. It is therefore advisable to provide hearing assistance to both of the user's ears with one hearing aid in each case (binaural hearing assistance). In many cases, however, there are different degrees of hearing loss in the user's left and right ear, thus making it necessary to adjust the hearing aids to match the relevant hearing loss of the respective ear by means of different parameter settings. Frequently, however, hearing aids are not embodied in a side-specific manner in terms of their housing design. This applies in particular to hearing aids that are wearable on the ear, in particular behind the ear (BTE), but also to universally fitting hearing aids that are wearable in the ear (HE). This can easily lead to mix-ups, with the result that e.g. a hearing aid having the parameter settings for compensating for the hearing loss in a user's left ear is worn in the right ear and vice versa. In order to avoid transposing the hearing aids it is known to provide colored markings on the hearing aids. Thus, for example, the hearing aid for providing hearing assistance to the right ear can be provided with a red marking in order to differentiate the two hearing aids. The hearing aid wearer must personally make sure that the respective hearing aid is used for the correct ear.

The unexamined published German application EP 1 722 597 A1 discloses a hearing aid having a light-emitting diode which indicates to a user whether the hearing aid in question is to be worn on the left or on the right ear.

A hearing aid having a housing and a cover element which can be releasably attached thereto is known from the unexamined published application US 2002/0106096 A1, wherein the user can recognize on the basis of the color of the cover element whether the hearing aid is to be worn on the left or on the right ear.

The unexamined published application WO 2004/077 087 discloses a device for determining position by means of a mobile transponder, wherein the transponder comprises two antennas spaced apart from each other and the direction from which a signal is sent to the antennas can be identified by determining a field strength difference signal.

SUMMARY OF THE INVENTION

The object of the present invention is to avoid, in the case of a hearing aid system having a first and a second hearing aid for providing binaural hearing assistance to a user, the hearing aids being operated with parameter settings that are unsuitable for providing hearing assistance to the user's respective ear.

This object is achieved by a hearing aid system and by a method for operating a hearing aid system as claimed in the claims.

In a hearing aid, an input signal is recorded by means of an input transducer and converted into an electrical input signal. Typically, at least one microphone which picks up an acoustic signal and converts it into an electrical input signal serves as the input transducer. Modern hearing aids frequently comprise a microphone system having a plurality of microphones in order to achieve reception that is dependent on the direction of arrival of acoustic signals, a directional characteristic. However, telephone coils or antennas for picking up electromagnetic input signals and converting them into electrical input signals are also commonly used as input transducers. The input signals converted into electrical input signals by the input transducer are supplied to a signal processing unit for further processing and amplification. The further processing and amplification take place in order to compensate for a user's individual hearing loss generally as a function of the signal frequency of the input signal. At its output, the signal processing unit yields an electrical output signal which is fed via an output transducer to the hearing aid wearer's ear such that the latter perceives the output signal as an acoustic signal. Receivers which generate an acoustic output signal are typically used as output transducers. Also known, however, are output transducers for generating mechanical oscillations that directly stimulate certain parts of the ear, such as for example the ossicles, to vibrate. Also known are output transducers which directly stimulate nerve cells of the ear. A hearing aid additionally comprises a voltage source ((rechargeable) battery) for supplying power to the electronic components. In addition control elements (on/off switch, program switch, volume control, etc.) may also be present.

By means of parameter settings the hearing aid can be adjusted to match the individual hearing loss in the user's respective ear. The settings are usually made by a hearing aid acoustician during a fitting session, with a respective hearing aid usually being connected during the fitting to a fitting computer specially configured for fitting purposes. The hearing aid acoustician specifies the parameter settings for the respective hearing aid and transfers them to the hearing aid at the end of a fitting session. Said settings henceforth determine how the signals will be processed in the signal processing unit of the hearing aid in question in order to compensate for the individual hearing loss in the respective ear.

In addition to the permanent parameter settings specified after a fitting session, hearing aids can also be adjusted manually or automatically to the user's preferences as well as to changing environmental conditions by means of further parameter settings. For example, the user can manually vary the volume or the hearing aid in question automatically adapts itself to suit changing hearing environments (conversation in quiet environment, conversation with background noise, watching television, telephoning, etc).

Modern hearing aid systems having a left and a right hearing aid have the capability to transmit data wirelessly between the hearing aids. Thus, for example, a manual volume setting carried out once on one hearing aid can take effect in both hearing aids of the hearing aid system in question. The hearing aids are equipped with corresponding transmit and receive units for that purpose.

According to the invention, the hearing aid system having a first and a second hearing aid, in each case wearable either on the user's left ear or on the user's right ear, has a side detection device for automatically detecting which of the two hearing aids is currently being worn on the user's left ear and which of the two hearing aids is currently being worn on in the user's right ear.

One embodiment variant of the invention provides that the user is made aware, by means of a signal discernible to him/her, if the hearing aids are in each case not on the ear designated for that purpose. For example, the hearing aid wearer can be prompted to swap over the hearing aids by means of a voice output such as e.g. "Please swap over left and right hearing aids!".

In a particularly advantageous embodiment variant of the invention it is provided that both hearing aids of a respective hearing aid system have stored both the parameter settings for compensating for the hearing loss in the left ear and the parameter settings for compensating for the hearing loss in the right ear. After the respective hearing aid has automatically detected by means of the side detection device on which of the user's ears it is currently being worn, the parameter settings for compensating for the hearing loss in the respective ear are activated automatically. This is particularly convenient for the user since he/she no longer has to differentiate between a left and a right hearing aid and a hearing aid attached to the ear is always correctly adjusted to the hearing loss in the respective ear. Unintentionally transposing the two hearing aids and operating them with parameter settings unsuitable for the respective ear thus become impossible.

In the hearing aid system according to the invention, a device for wireless signal transmission between the hearing aids is advantageously present. In this case at least one of the hearing aids includes a transmitting coil for transmitting a detection signal and at least the other hearing aid has two receiving coils physically spaced apart from each other for receiving the detection signal sent by the first hearing aid. The two receiving coils do not necessarily have to be two coils that are completely detached from each other. Rather, two coils can also be wound onto a common core or the two coils are formed by means of a winding with a center tap.

If the two hearing aids of a hearing aid system according to the invention are located in the wearing position provided therefor, the transmitting coil of the one hearing aid and the two receiving coils of the other hearing aid are advantageously aligned relative to one another in such a way that a detection signal originating from the transmitting coil of the first hearing aid reaches the first receiving coil first and then reaches the second receiving coil of the second hearing aid. This is made possible for example in that the transmitting coil of one hearing aid and the two receiving coils of the other hearing aid in each case are arranged at least approximately along a straight line in the case of hearing aids being worn.

As a result of the physical separation of the two receiving coils the detection signal originating from the first hearing aid is present with a different field strength at the two receiving coils of the receiving hearing aid. This difference can be detected and evaluated by means of an evaluation unit. The different field strengths lead for example to a level difference between the first detection receive signal generated by the first receiving coil in response to the sent detection signal and the second detection receive signal generated by the second receiving coil in response to the sent detection signal. Said level difference can be registered and evaluated. In particular the receiving coil in which the higher field strength is registered is situated closer to the transmitting coil than the other receiving coil. As a result the respective hearing aid automatically detects which side of the housing is facing toward the user's head and which side of the housing is facing away from the user's head. This in turn allows a clear inference to be drawn as to whether the hearing aid in question is currently being worn on the left or right ear.

An alternative embodiment variant of the invention make provision for evaluating the interaural time difference, i.e. the difference in time of arrival of a detection signal originating from the transmitting coil of the first hearing aid at the two receiving coils of the second hearing aid. The difference in time of arrival leads to a phase difference between the first detection receive signal generated by the first receiving coil in response to the sent detection signal and the second detection receive signal generated by the second receiving coil in response to the sent detection signal. A detection receive signal arriving at one receiving coil in advance of the other receiving coil allows the conclusion to be drawn that the respective receiving coil of the receiving hearing aid is situated closer to the sending hearing aid compared to the other receiving coil.

If for example—in relation to the user's straight-ahead viewing direction and the typical manner of wearing the hearing aids—a higher field strength is measured at the receiving coil arranged closer to the right side of the housing of the respective hearing aid or if the generated detection receive signal arrives there in advance of the detection receive signal generated in the receiving coil situated closer to the left side of the housing, the hearing aid in question is situated on the user's left ear.

In order that the detection signals that are receivable at the location of the first receiving coil and at the location of the second receiving coil differ from each other to the greatest extent possible in terms of their field strength and phase, the two receiving coils should be arranged spaced as far as possible apart from each other inside the respective hearing aid. Thus, one receiving coil can be situated as close as possible to the left side of the hearing aid housing and the other receiving coil as close as possible to the opposing right side of the hearing aid housing. This distance becomes particularly large if both receiving coils are attached directly on the opposite areas of the housing, for example through the use of MID (Molded Interconnect Device) technology.

In the hearing aid system according to the invention, the transmitting coil of the first hearing aid and at least one of the receiving coils of the second hearing aid are advantageously used also for wireless signal transmission between the two hearing aids. The additional overhead for automatic side detection is therefore kept within limits in comparison with a conventional hearing aid system in which wireless signal transmission is provided.

The detection signal which is transmitted from the first hearing aid to the second can be a signal which is provided solely for automatic side detection. However, it is also possible that in the case of a hearing aid system in which wireless signal transmission between the hearing aids is provided anyway for data transmission purposes, for the purpose of synchronization of the two hearing aids for example, a correspondingly transmitted signal is additionally evaluated also according to the invention for the purpose of side detection. A special signal exclusively for side detection can thus be dispensed with.

According to the invention, the detection receive signals generated by the receiving coils in response to the detection signal can be evaluated directly, for example in terms of their amplitudes and their phases, although where appropriate the evaluation can also be carried out only following a further processing of these signals.

Theoretically it is sufficient if one of the two hearing aids of an inventive hearing aid system is equipped with two receiving coils for receiving a detection signal. Said hearing aid can then automatically detect in the above-described manner whether it is being used on the user's left or right ear. This information could then be transmitted wirelessly to the other hearing aid of the respective hearing aid system, whereby the latter also automatically detects on which of the user's ears it is currently being worn. Advantageously, however, both hearing aids of a respective hearing aid system are embodied identically, such that each detects in the same way on which of the user's ears it is currently being worn. A wireless data transmission between the hearing aids can then be used for checking purposes. If both hearing aids detect the same wearing position, it is clear that an error must be present and the automatic side detection can be performed once again if necessary.

BRIEF DESCRIPTION OF THE DRAWINGS

The invention is explained in more detail below with reference to an exemplary embodiment.

DETAILED DESCRIPTION OF THE INVENTION

Figure 1:
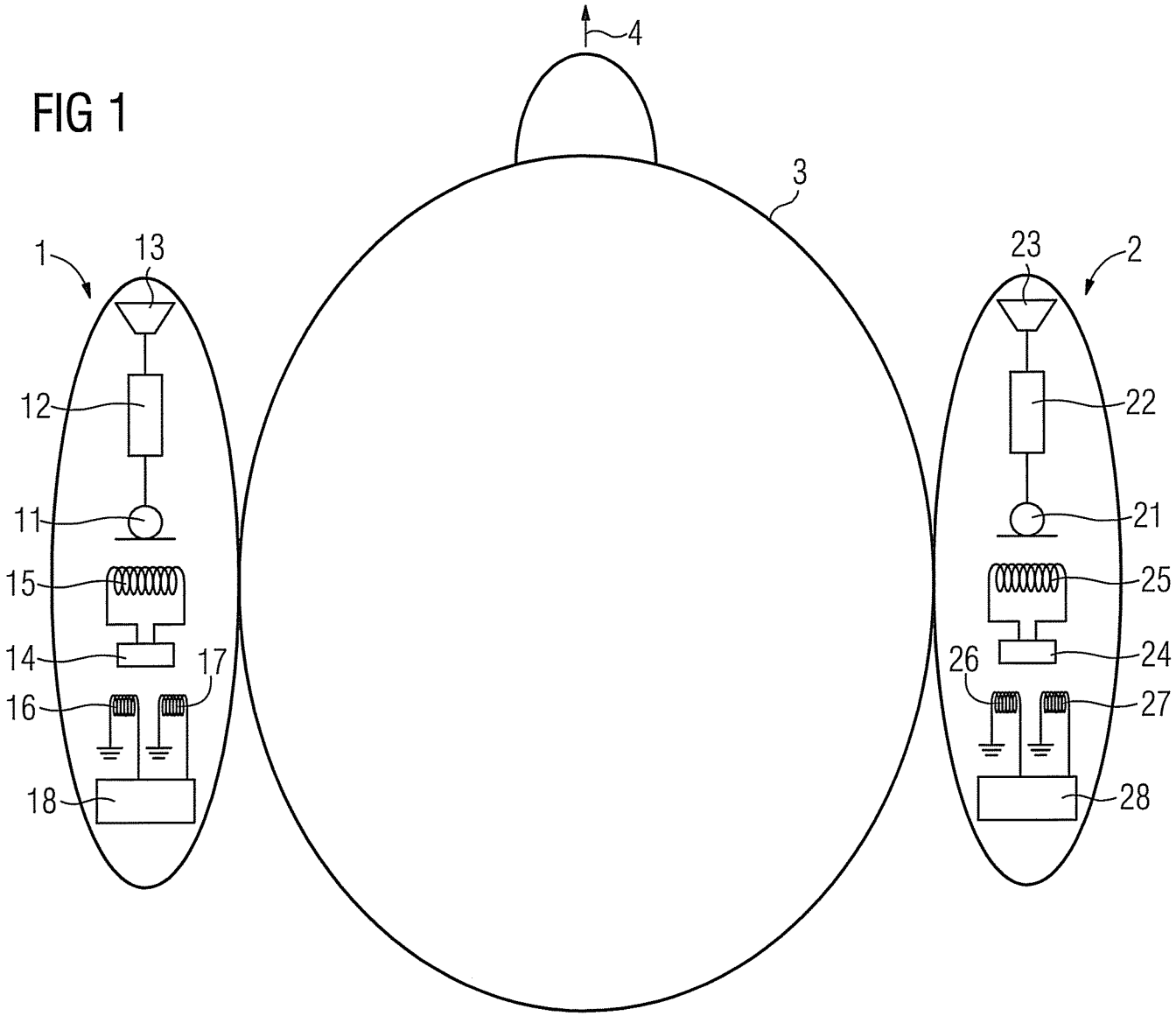
FIG. 1 shows a hearing aid system having a first and a second hearing aid according to the invention in a greatly simplified schematic representation and FIG. 2 shows a simplified schematic diagram of an evaluation unit of a hearing aid in question.

FIG. 1 shows in a greatly simplified schematic representation an inventive hearing aid system 1, 2 which is worn on the head 3 of a user and in particular behind the ears (not shown). The arrow 4 indicates the straight-ahead viewing direction of the user. The hearing aid system 1, 2 comprises a first hearing aid 1 and a second hearing aid 2 that is identical in design to the first. The hearing aids 1 and 2 are not embodied according to any specific side and so basically can each be worn either on the user's left or on the user's right ear.

The microphones 11 and 21 are present in order to pick up an acoustic input signal and convert it into an electrical input signal. The electrical input signals are supplied to the signal processing units 12 and 22, respectively, for processing and frequency-dependent amplification. The electrical output signals resulting therefrom are supplied to the receivers 13 and 23, respectively, which convert the electrical output signals into acoustic output signals which are then supplied to the user's ear. The signal processing in the signal processing units 12 and 22 can in each case be adapted by means of parameter settings to match the individual hearing loss in the user's respective ear as well as to match the acoustic environment in which the hearing aids 1 and 2 are currently situated.

As a special feature, in the case of the hearing aid system 1, 2 according to the exemplary embodiment, the parameter settings for compensating for the hearing loss in the user's left ear and the parameter settings for compensating for the hearing loss in the user's right ear are stored both in the signal processing unit 12 and in the signal processing unit 22, with only one of the respective parameter sets being activated in each of the hearing aids 1 and 2 in each case. For the purpose of wireless data transmission between the hearing aids 1 and 2, the hearing aids additionally include the transmit units 14 and 24, respectively, as well as the transmitting coils 15 and 25 connected thereto. The receiving coils 16 and 17 or, as the case may be, 26 and 27 are present in order to receive the signals sent from the other hearing aid in each case, with the receiving coils 16 and 26—in relation to the usual manner of wearing and the straight-ahead viewing direction 4 of the user—being arranged closer to the left side of the housing and the receiving coils 17 and 27 being arranged closer to the right side of the housing of the respective hearing aids 1 and 2. By means of the wireless data transmission between the hearing aids 1 and 2 it is for example ensured that the two hearing aids 1 and 2 are always in the same hearing program for matching to the current hearing environment.

The hearing aids 1 and 2 according to the exemplary embodiment differ from conventional hearing aids suitable for wireless signal transmission in that two receiving coils 16 and 17 or, as the case may be, 26 and 27 physically separated from each other are present in each case. The receiving coils 16, 17 or, as the case may be, 26, 27 are therein arranged inside the hearing aids 1 and 2 in such a way that they are at different distances from the transmitting coil of the other hearing aid in each case. This has two types of effect during the reception of a detection signal. Thus, the detection signal at the location of the receiving coil that is situated closer to the transmitting coil has a higher field strength than in the case of the receiving coil situated further away. Furthermore the detection signal arrives first at the receiving coil situated closer to the transmitting coil of the other hearing aid in each case, with the result that the detection receive signals generated by the two receiving coils exhibit a phase difference. Advantageously, both the peak values and the phase difference of the detection receive signals generated in the receiving coils 16 and 17 or, as the case may be, 26 and 27 can be determined in the evaluation units 18 and 28, respectively. If, for example, the hearing aid 2 detects that the detection signal sent by the transmitting coil 15 of the hearing aid 1 has a higher field strength at the location of the receiving coil 26 than at the location of the receiving coil 27 or that a first detection receive signal generated by the receiving coil 26 in response to the sent detection signal precedes a second detection receive signal generated by the receiving coil 27, it is clear therefrom that the receiving coil 26 located closer to the left side of the housing of the hearing aid 2 is situated at a smaller distance from the transmitting coil 15 of the hearing aid 1 compared to the receiving coil 27. In this way it is automatically detected that the hearing aid 2 is situated in the user's right ear. A corresponding automatic side detection also takes place in the hearing aid 1, with a detection signal originating from the transmitting coil 25 of the hearing aid 2 being detected in the physically spaced-apart receiving coils 16 and 17. Accordingly the hearing aid 1 according to the exemplary embodiment detects that it is located in the user's left ear.

In response to the automatic side detection, the parameter settings for adjusting the hearing aid 1 to match the hearing loss in the user's left ear are automatically activated in the hearing aid 1 and the parameter settings for adjusting the hearing aid 2 to match the hearing loss in the user's right ear are automatically activated in the hearing aid 2.

The automatic side detection and automatic adjustment of the respective hearing aid to match the respective ear results in the greatest possible comfort for the user. The user can attach each of the two hearing aids of the inventive hearing aid system either to his/her left ear or to his/her right ear. Mixing up the two hearing aids and operating a hearing aid with parameter settings that are unsuitable for providing hearing assistance to the respective ear are thereby prevented.

Figure 2:
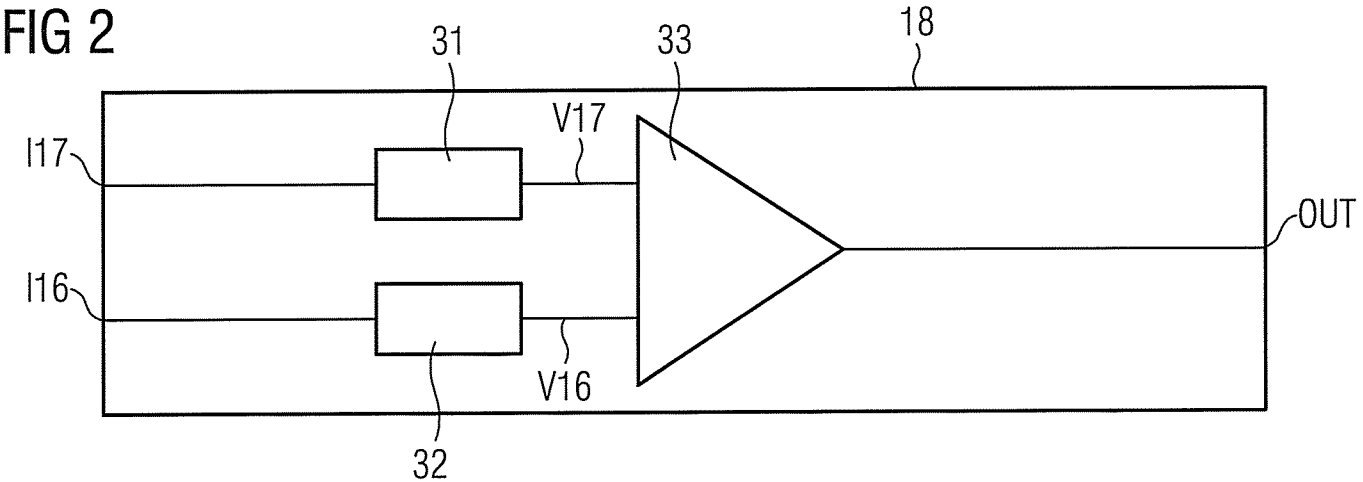

FIG. 2 shows the schematic diagram of the evaluation unit 18 for measuring different field strengths with which the detection signal originating from the second hearing aid 2 is present at the location of the receiving coil 16 and at the location of the receiving coil 17 of the first hearing aid 1. Toward that end the detection receive signal 117 generated by the receiving coil 17 and the detection receive signal 116 generated by the receiving coil 16 are supplied to the evaluation unit 18 at its inputs. The input signal 117 is first supplied to a peak value detector 31 and the input signal 116 to a peak value detector 32. The peak value detector 31 yields the output signal V17 and the peak value detector 32 the output signal V16. The two signals V17 and V16 are supplied to a comparator 33 which yields the output signal "OUT". If the peak value V17 is greater than the peak value V16, the output signal "OUT" is assigned logic 1. If, on the other hand, the peak value V16 is greater than the peak value V17, the output signal "OUT" is assigned logic 0. In this case logic 1 of the output signal "OUT" relates to a hearing aid worn on the left ear and logic 0 of the output signal "OUT" relates to a hearing aid worn on the right ear.

The output signal "OUT" of the evaluation unit 18 is supplied to the signal processing unit 12 which, in the case of logic 1, automatically activates the parameter settings for compensating for the hearing loss in the left ear and, in the case of logic 0, automatically activates the parameter settings for compensating for the hearing loss in the right ear.

The invention claimed is:

1. A hearing aid system, comprising:

a first hearing aid wearable either on a user's left ear or on a user's right ear;

a second hearing aid wearable either on the user's left ear or on the user's right ear; and a side detection device for automatically detecting which of the first hearing aid and the second hearing aid is worn on the user's left ear and which of the first hearing aid and the second hearing aid is worn on the user's right ear, wherein the first hearing aid and the second hearing aid are adjustable by a first parameter setting to match an individual hearing loss in the user's left ear and by a second parameter setting to match an individual hearing loss in the user's right ear, wherein both of the first parameter setting and the second parameter setting are stored in both of the first hearing aid and the second hearing aid, and wherein the first parameter setting or the second parameter setting is activated automatically by a respective hearing aid of the first hearing aid and the second hearing aid based on the automatic detection of an ear on which the respective hearing aid is being worn.

2. The hearing aid system as claimed in claim 1, wherein the side detection device comprises a transmitting coil in the first hearing aid for transmitting a detection signal.

3. The hearing aid system as claimed in claim 2, wherein the side detection device comprises:

a first receiving coil in the second hearing aid for receiving the detection signal and for generating a first detection receive signal, and a second receiving coil in the second hearing aid spaced apart from the first receiving coil for receiving the detection signal and for generating a second detection receive signal, and wherein in relation to a straight-ahead viewing direction of the user and a typical wearing position of the second hearing aid on one of the user's ears, the first receiving coil is arranged closer to a left side of a housing of the second hearing aid and the second receiving coil is arranged closer to a right side of the housing of the second hearing aid.

4. The hearing aid system as claimed in claim 3, wherein the side detection device comprises an evaluation unit for comparing the first detection receive signal and the second detection receive signal.

5. The hearing aid system as claimed in claim 4, wherein the evaluation unit compares a first field strength of the detection signal at a location of the first receiving coil and a second field strength at a location of the second receiving coil, and wherein the second hearing aid is automatically detected being worn on the right ear if the first field strength is higher than the second field strength, and wherein the second hearing aid is automatically detected being worn on the left ear if the second field strength is higher than the first field strength.

6. The hearing aid system as claimed in claim 4, wherein the evaluation unit detects a phase difference between the first detection receive signal and the second detection receive signal, wherein the second hearing aid is automatically detected being worn on the right ear if the first detection receive signal precedes the second detection receive signal, and wherein the second hearing aid is automatically detected being worn on the left ear if the first detection receive signal trails behind the second detection receive signal.

7. The hearing aid system as claimed in claim 2, wherein data is transmitted between the first hearing aid and the second hearing aid, wherein the transmitting coil sends out the data, and wherein at least one of the first receiving coil and the second receiving coil receives the data.

8. The hearing aid system as claimed in claim 1, wherein side information is stored in the first hearing aid and the second hearing aid, and wherein a warning signal discernible by the user is output by the hearing aid system if at least a respective hearing aid of the first hearing aid and the second hearing aid is not being worn on or in an ear designated for the respective hearing aid.

9. A method for operating a hearing aid system having a first hearing aid and a second hearing aid each wearable either on a user's left ear or on a user's right ear, the method comprising:

sending a detection signal by the first hearing aid;

receiving the detection signal by a first receiving coil of the second hearing aid;

generating a first detection receive signal by the first receiving coil of the second hearing aid;

generating a second detection receive signal by a second receiving coil of the second hearing aid spaced apart from the first receiving coil;

comparing the first detection receive signal with the second detection receive signal; and automatically detecting whether the second hearing aid is worn on the user's left ear or on the user's right ear based on the comparison.

10. The method as claimed in claim 9, wherein an amplitude of the first detection receive signal is compared with an amplitude of the second detection receive signal.

11. The method as claimed in claim 9, wherein a phase of the first detection receive signal is compared with a phase of the second detection receive signal.

12. The method as claimed in claim 9, wherein a signal resulting from the first detection receive signal is compared with a signal resulting from the second detection receive signal.

* * * * *